United States Patent [19]

Musiani

[11] 4,424,883

[45] Jan. 10, 1984

[54] SILENCER FOR PNEUMATIC EQUIPMENT

[75] Inventor: Franco Musiani, Monte S. Pietro, Italy

[73] Assignee: Panda S.r.l., Bologna, Italy

[21] Appl. No.: 356,446

[22] Filed: Mar. 9, 1982

[30] Foreign Application Priority Data

Mar. 31, 1981 [IT] Italy ..... 4805/81[U]

[51] Int. Cl.[3] ..... F01N 1/24

[52] U.S. Cl. ..... 181/258; 181/230; 181/243; 55/276

[58] Field of Search ..... 181/229–231, 181/238, 239, 241, 243, 258, 267, 282, 252; 55/276, DIG. 20

[56] References Cited

U.S. PATENT DOCUMENTS

| | | | |
|---|---|---|---|
| 226,905 | 4/1880 | Curie | 181/257 |
| 3,889,776 | 6/1975 | Postma | 181/258 |
| 4,109,753 | 8/1978 | Lyman | 181/252 |

FOREIGN PATENT DOCUMENTS

| | | | |
|---|---|---|---|
| 2601483 | 7/1977 | Fed. Rep. of Germany . | |
| 7104328 | 10/1972 | Netherlands . | |
| 9414 | of 1914 | United Kingdom . | |
| 235929 | 6/1925 | United Kingdom . | |
| 2056563 | 3/1981 | United Kingdom | 181/230 |

*Primary Examiner*—Benjamin R. Fuller
*Attorney, Agent, or Firm*—Darby & Darby

[57] ABSTRACT

Disclosed herein is a silencer constituted by a casing, open at the lower extremity made to communicate with the source of compressed gases, and closed at the top by a cover, inside which are placed, from the bottom upwards, a first element, a filter and a second element which, jointly with the inner surface of the casing, define a first, a second and a third expansion chamber, respectively, for the compressed gases.

The first expansion chamber communicates with the open extremity of the casing, the second contains the aforementioned filter, while the third, via a slit made in the cover, communicates with the outside. The first and second expansion chamber are inter-communicating because of through holes drilled in the first element, and likewise the second and third expansion chamber are inter-communicating because of through holes drilled in the second element.

11 Claims, 4 Drawing Figures

FIG1
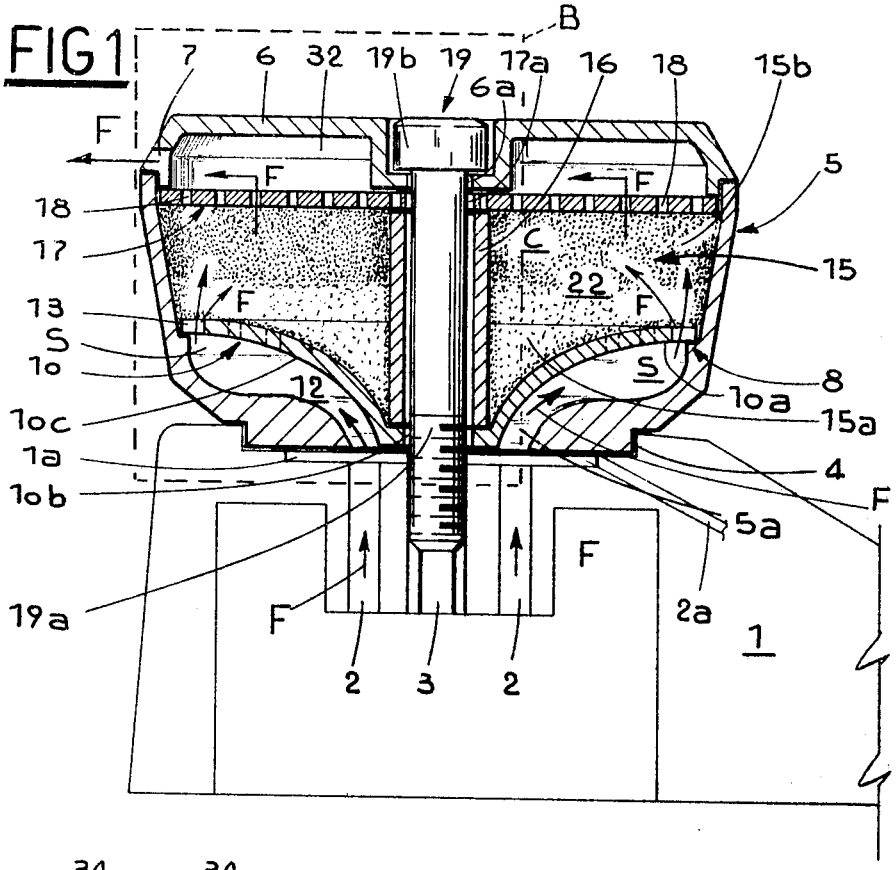
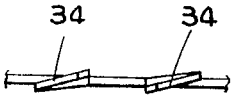
FIG3
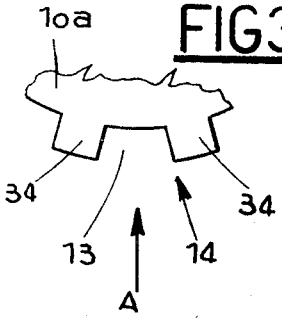
FIG2
FIG4
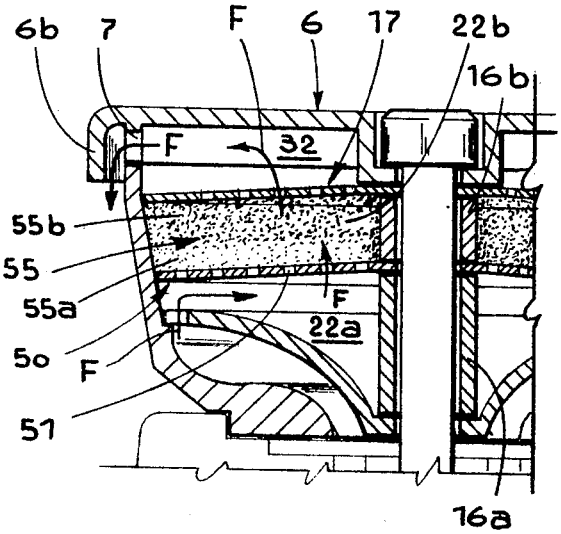

SILENCER FOR PNEUMATIC EQUIPMENT

BACKGROUND OF THE INVENTION

The invention relates to a silencer that is particularly suitable for deadening the noise caused by compressed air released externally through one or more discharge ducts, either from a pneumatic gun for forcibly inserting fixing elements such as nails, metal staples and similar, or from other items of pneumatic equipment.

DESCRIPTION OF THE PRIOR ART

As is known, in compressed air operated guns of the aforementioned type, an operating piston controlled by a valve actuated by the trigger, is destined, first of all, to place the compressed air tank incorporated in the gun, in communication with the operating cylinder, and then subsequently, to place the said operating cylinder in communication with the outside, via one or more discharge ducts.

The purpose of fitting a silencer in series with the said discharge duct/s is, essentially, to deaden the noise produced by the very high speed at which the flow of compressed air from the operating cylinder commences intermittently.

The pressure front downstream of the operating piston becomes, in fact, steeper as it passes along the discharge duct/s, and this is because the velocity of the particles of air in the high pressure zone (roughly the same as the velocity of sound) is greater than in the low pressure zone. The said front is reflected from the outlet, then from the operating piston, and so on and so forth, and it is attenuated by the reflection energy losses; the said energy losses being accompanied by noise.

Various methods exist for deadening the noise, and among these there is the friction method (consisting in dampening the pressure wave with viscous means, such as porous material), and the method that exploits the reflection of sound waves manifested after a brusque decrease in the passage area of the compressed air that is being discharged. Because of known physical considerations that need not be listed herein, downstream of the said contractions, provision is made for at least one expansion chamber.

SUMMARY OF THE INVENTION

The object the invention sets out to achieve is to make available a silencer for pneumatic equipment that consists of a limited number of component parts, so assembled as to make full use of the system whereby noise is lost through friction, and of that whereby noise is lost through the reflection of sound waves.

A further object of the invention is to make available a silencer for pneumatic equipment that satisfies the aforementioned object, and wherein the component parts can, furthermore, be easily and rapidly put together and, should the need arise, be taken apart, without in any way prejudicing the functional qualities of the said silencer.

Yet another object still of the invention is to make available a silencer for pneumatic equipment that can be easily and quickly locked to and unlocked from the body of the compressed air operated device with which it works in conjunction.

The said objects are all achieved with the silencer for pneumatic equipment according to the invention, comprising a casing, open at one extremity and closed at the other by means of a cover in which there is at least one slit, that can be locked in a removable fashion to the body of the compressed gas device with which it is used, in such a way that the open extremity communicates directly with the duct for the discharge of the gases in the said device, there being in the said casing, starting at the open extremity and going towards the cover, stably inserted and, at the same time, closely enshrouded peripherally by the inside surface of the casing, a first element, a filter, and a second element, of which the first element defines, in cooperation with the relevant part of the inside surface of the casing, a first expansion chamber for the compressed gases, as well as, in cooperation with the second element and with the strip of the inside surface of the casing delimited by the said elements, a second compressed gas expansion chamber that contains the said filter, while the second element defines, furthermore, in cooperation with the cover, a third expansion chamber for the compressed gases; both the said first and second element being provided with a plurality of through holes to render the first chamber communicating with the second, and the second chamber communicating with the third, respectively.

The specific task of the silencer is to cause the compressed gas to pass from the first to the second chamber, from the second to the third chamber and thence to the atmosphere (noise loss through the reflection of sound waves), as well as to cause the said gas to pass through the porous material (filter) that fills the second chamber (noise loss through friction); the purpose of the first chamber being to cause the compressed gas to expand (without giving rise to vortical motion) with it tending to keep a laminar flow up to the point corresponding to the inlet orifices of the through holes in the first element, where the pressure of the gas (as a consequence of the aforementioned expansion) is maximum, that is to say, at an optimum level for the gas to pass through the said holes in the first element.

In order that the foregoing may take place in the best possible way, the surface of the said first element that points towards the open extremity of the casing is of a funnel conformation and is so oriented as to have the minimum area thereof positioned in the region of the said open extremity.

BRIEF DESCRIPTION OF THE DRAWINGS

The characteristics of the silencer for pneumatic equipment forming the subject of the invention are emphasized in the text that follows, with reference to the accompanying table of drawings, in which:

FIG. 1 shows, in a front sectional view along an axial plane, the silencer in question;

FIG. 2 shows, in a plan view, one part of the baffle that constitutes an integral part of the silencer in question;

FIG. 3 shows, viewed in the direction of the arrow A, the part of the baffle depicted in FIG. 2;

FIG. 4 shows, in a second form of embodiment, the detail B in FIG. 1.

DESCRIPTION OF THE PREFERRED EMBODIMENTS

With reference to FIGS. 1, 2 and 3, shown diagrammatically at 1 is the head of a pneumatic gun, in the top part of which there is a circular indentation 4 that is coaxial and communicating with an annular chamber 1*a* into which run the extremities of the discharge ducts 2 (destined to place, in accordance with known systems not described herein, the operating cylinder of the gun in communication with the outside atmosphere at the time the operating piston that slides in the inside of the said cylinder adopts afresh the non-operative position) and the extremity of another discharge duct 2*a* belonging to the (non-illustrated) valve that operates the gun. Furthermore, placed centrally therein the indentation 4 has a threaded hole 3, mention of which will be made below.

Into the indentation 4 is inserted the open extremity 5*a* of a casing 5 (of circular section with lateral walls diverging upwards), the other extremity is sealed by a cover 6 in whose side there is a slit 7. Because of the said insertion, the extremity 5*a* communicates directly with the annular chamber 1*a*.

In the inside surface of the casing 5 there is a sudden break in the diametric continuity which gives rise to a step 8 onto which is placed, resting thereon, the outside edge 10*a* (of a circular development) of a first element 10 (in the center of which there is a through hole 10*b*). The said edge is closely enshrouded by the inside surface of the casing 5.

The surface 10*c* of the element 10 turned towards the extremity 5*a* extends symmetrically with respect to the axis of the hole 10*b* and is so shaped as to represent a baffle for the compressed gases (flow F) coming from the chamber 1*a*. For this purpose, the said surface 10*c* extends in funnel form and is oriented in such a way that the relevant minimum cross section be positioned at a point corresonding to the open extremity 5*a*. The said surface 10*c* and the opposite inside surface of the casing 5 define a first chamber 12 which, starting from the extremity 5*a* and going upwards, increases in volume: this causes, consequently, the expansion of the compressed gases F.

In the form of embodiment depicted in FIG. 1, the inside surface of the casing 5 opposite the said surface 10*c* is curved so as not to cause vortices which would bring about energy losses and consequential noise in the flow F of compressed gases. The surfaces that laterally delimit the chamber 12 are, in other words, of a conformation such as to tend to create a laminar flow for the compressed gases F.

The element 10, close to the outside edge 10*a*, is provided with a plurality of through holes 13 (parallel to the axis of the hole 10*b*) which, in one preferred form of embodiment, constitute spaces in a toothing 14 contained in the said edge 10*a* (FIGS. 2 and 3.) The teeth 34 of the said toothing are bent on one and the same side (FIG. 3) with respect to a plane perpendicular to the axis of the element 10, and the reason for this will be clarified below.

Above the element 10, in the region of the cover 6, there is a second element 17 that is peripherally closely enshrouded by the inside surface of the casing and is provided with a plurality of transverse through holes and has in the center a through hole 17*a*. In one preferred form of embodiment the element 17 takes the form of a net. The position of the element 17 is stabilized with respect to the casing by means of a spacer 16 (constituted by a tubular member coaxial with respect to the holes 10*a* and 17*a*) interposed between the said element 17 and the said element 10.

The facing surfaces of the elements 10 and 17, in cooperation with the inside surface of the casing 5, define a second chamber 22 which, in the form of embodiment shown in FIG. 1 is filled with a filter constituted by, for example, a layer 15 of porous material. In one preferred form of embodiment, the said layer 15 consists of two consecutive parts, 15*a* and 15*b*, that mate, one with the element 10 and the other with the element 17. The porosity of the material in part 15*a* is greater than that of the material in the part 15*b*, and the reason why that is so will be explained hereinafter.

The element 17 and the opposite surface of the cover 6 define a third expansion chamber 32.

The locking one to the other of the component parts of the silencer according to the invention, and the locking of the said silencer to the head 1 of the pneumatic gun, is achieved by inserting, progressively, the shank 19*a* of a bolt 19 into a through hole 6*a* made centrally in the cover 6, into the hole 17*a*, into the inside of the spacer 16, and into the hole 10*b*, so that the said shank engages in the hole 3 to which prior reference has been made, until the head 19*b* of the bolt abuts with the rim of the aforementioned hole 6*a*.

A description will now be given of the operation of the pneumatic silencer forming the subject of the invention.

The compressed gases F coming from the chamber 1*a* gradually expand as they pass along the chamber 12. The expansion of the gases causes a decrease in the velocity thereof and, in consequence, an increase in the gas pressure, which becomes maximum in zone S.

Via the holes 13, the gases from the zone S invade the chamber 22 (where again they expand). This causes, through the reflection of sound waves, an initial noise loss.

The gases F that pass through the holes 13 are either totally or partially deviated laterally by the bent teeth 34 and they tend to go into the central zone C of the chamber 22 on account of the fact that the porosity of the part 15*a* is greater than that of the part 15*b*, the whole purpose of this being to increase the path followed by the gases F in the inside of the chamber where they are slowed down by the layer 15 of porous material, thereby achieving a noise loss through friction.

Via the holes 18 drilled in the element 17, from the chamber 22 the gases invade the chamber 32 (where once again they expand), thereby achieving a further noise loss through the reflection of sound waves.

From the chamber 32, the gases F are then discharged, via the slit 7, into the atmosphere where they undergo a definite expansion. This again results in a further noise loss through the reflection of sound waves.

For flows of compressed gases F of a limited capacity, the layer 15 can be made with a constant porosity, while in the case of capacities that are considerable, the layer 15 can be constituted by two consecutive parts of different porosity or, by way of an alternative, the variant as per FIG. 4 can be utilized.

With reference to FIG. 4, at 50 there is a third element (constituted, for example, by a disk containing a plurality of transverse through holes 51) stably positioned in the chamber 22 since it is closely enshrouded by the inside surface of the casing which, as will be recalled, is of truncated cone shape, and is, furthermore, interposed between two spacers 16*a* and 16*b* (FIG. 4). The element 50 divides the chamber 22 into two parts, namely a lower part 22*a* and an upper part 22*b*, the former empty and the latter filled with a filter constituted by a layer 55 of porous material which, in turn, consists of two consecutive parts, 55*a* and 55*b*, of which the former mates with the element 50 and the latter with the element 17; the porosity of the part 55*a* being lesser than that of the part 55*b*.

In the cover 6, according to the form of embodiment depicted in FIG. 4, placed laterally there are a number of equidistant slits 7 (eight for example) and, furthermore, starting at the upper part of the cover, there is a tail piece 6*b* that points downwards and is of a circular development, the diameter being greater than that of the part of the cover that contains the slits 7. The task of the tail piece 6*b* is to deviate downwards the compressed gases F which, via the slits 7, from the chamber 32 are released into the atmosphere.

Suitable plates positioned above the cover and fixed thereto at one extremity, while the other extremity is bent downwards in such a way that it be located opposite the corresponding slit, can be provided in place of the tail pieces 6*b*.

The compressed gases F that pass through the holes 13 are deviated laterally by the bent teeth 34 of the element 10 as they invade the part 22*a* of the chamber 22. In this way, they are deviated out of preference towards the inside of the part 22*a*. The said part 22*a* constitutes an expansion chamber for the gases F coming from the hole 13 and this is optimal since the passage of the gases into the part 22*b* is achieved through the full number of holes 51 with which the element 50 is provided.

In this way, the damping action of the part 55*a* of the layer 55 (the one of a lesser porosity) takes place in the most critical zone in the path followed by the gases F across the layer 55, that is to say, in the region of the discharge orifices of the holes 51 where the velocity of the gases is maximum.

The gases F from the part 22*b* (where they expand and, at the same time, are slowed down) invade, via the holes 18, the chamber 32 and pass from there, via the slits 7, into the atmosphere. As the gases F pass through the slits 7, they are deviated downwards by the tail piece 6*a* and thus the source of the noise (namely the gases F released into the atmosphere) tends to be kept away from the ears of the operator.

The silencer, in the form of embodiment envisaged in FIG. 4, deadens the discharge noise because of noise being lost through the reflection of sound waves (with the gases F passing through the holes 13, 51 and 18 and through the slits 7) and because of noise being lost through friction (with the gases F passing across the layer 55).

Since the foregoing description has been given purely as an unlimited example, all possible variants in respect of the constructional details (for example, the taper of the inside surface of the casing 5 could be used, in place of the step 8, to support the element 10) are understood to fall within the technical solution as outlined above and claimed below.

What is claimed is:

1. Silencer for pneumatic equipment, comprising a casing, open at one extremity and closed at the other by means of a cover in which there is at least one slit, that can be locked in a removable fashion to the body of the compressed gas device with which it is used, in such a way that the open extremity communicates directly with a duct for the discharge of the gases in the said device, there being in the said casing, starting at the open extremity and going towards the cover, stably inserted and, at the same time, closely enshrouded peripherally by the inside surface of the casing, a first element, a filter, and a second element, of which the first element defines, in cooperation with the relevant part of the inside surface of the casing, a first expansion chamber for the compressed gases, as well as, in cooperation with the second element and with a portion of the inside surface of the casing delimited by the said elements, a second compressed gas expansion chamber that contains the said filter, while the second element defines, furthermore, in cooperation with the cover, a third expansion chamber for the compressed gases; both the said first and second elements being provided with a plurality of through holes to render the first chamber communicating with the second, and the second chamber communicating with the third, respectively, characterized in that said filter is constituted by a layer of porous material, said layer of porous material completely filling the aforementioned second expansion chamber and being constituted by at least two consecutive parts, namely a first part and a second part, that mate with the first and the second elements, respectively, the first part having a porosity greater than that of the second part.

2. Silencer according to claim 1, wherein the surface of the said first element that points towards the open extremity of the casing is of a funnel conformation and is so oriented as to have the minimum area thereof positioned in the region of the said open extremity.

3. Silencer according to claim 1, wherein the through holes in the first element constitute spaces in a toothing contained in the edge of the said first element closely enshrouded by the inside surface of the casing.

4. Silencer according to claim 3, wherein the teeth of the said toothing are all bent on one and the same side with respect to a plane perpendicular to the axis of the first element.

5. Silencer according to claim 1, wherein a third element whose periphery is closely and stably enshrouded by the portion of the inside surface of the casing existing between the said first and the said second element, is destined to divide the said second expansion chamber into two parts, namely a lower part and an upper part, the former empty and the latter filled with the said porous material, the said third element containing a plurality of through holes for communication between the said lower and upper parts of the second chamber.

6. Silencer according to claim 5, wherein the said layer of porous material is constituted by at least two consecutive parts, namely a first part and a second part, that mate with the third element and with the second element, respectively, the first part having a porosity lesser than that of the second part.

7. Silencer according to claim 1, wherein starting at the edge of the upper part of the cover there is a tail piece that extends externally with respect to the said cover and points towards the open extremity of the casing, in a position opposite the said slit.

8. Silencer according to claim 1, wherein the locking in a removable fashion of the silencer to the body of the device with which it is used, is achieved by at least one bolt, the shank of which passes progressively across the through holes in the cover, in the second element and in the first element in order to then engage with a corresponding threaded housing made in the said body, while the head of the bolt abuts with the said cover, the silencer comprising a tubular member, through which the shank of the bolt passes freely, interposed between the opposite surfaces of the said first and second element.

9. Silencer according to claim 1, wherein the said second element takes the form of a net.

10. Silencer according to claim 2, wherein the inside surface of the casing that delimits laterally, in cooperation with the opposite surface of the first element, the first expansion chamber, is curved so as not to cause vortices in the flow of the compressed gases contained in the said first chamber.

11. Silencer according to claim 5, wherein the locking in a removable fashion of the silencer to the body of the device with which it is used, is achieved by at least one bolt, the shank of which passes across through holes in the cover, in the second element, in the third element and in the first element in order to then engage with a corresponding threaded housing made in the said body, while the head of the bolt abuts with the said cover, the silencer comprising two tubular members through which the shank of the bolt passes freely, one of which interposed between the opposite surfaces of the said first and third element, and the other interposed between the opposite surfaces of the said third and second element.

* * * * *